US007303152B2

(12) United States Patent
Woods

(10) Patent No.: US 7,303,152 B2
(45) Date of Patent: Dec. 4, 2007

(54) VARIABLE AEROSOL NOZZLE

(76) Inventor: John R. Woods, 4540 Willens Ave., Woodland Hills, CA (US)

( * ) Notice: Subject to any disclaimer, the term of this patent is extended or adjusted under 35 U.S.C. 154(b) by 19 days.

(21) Appl. No.: 11/378,716

(22) Filed: Mar. 17, 2006

(65) Prior Publication Data

US 2007/0235563 A1 Oct. 11, 2007

(51) Int. Cl.
*B05B 1/32* (2006.01)

(52) U.S. Cl. ..... 239/456; 239/333; 239/337; 239/437; 239/439; 239/458; 239/505; 239/513; 239/515; 239/602

(58) Field of Classification Search ..... 239/288–288.5, 239/329, 333, 337, 373, 436, 437–439, 451, 239/499, 456–458, 505, 510, 511, 514, 515, 239/539, 541, 602, 394
See application file for complete search history.

(56) References Cited

U.S. PATENT DOCUMENTS 3,936,000 A * 2/1976 Weyn ..... 239/288.5
4,883,227 A * 11/1989 Maas ..... 239/333
5,397,060 A * 3/1995 Maas et al. ..... 239/333
5,941,462 A 8/1999 Sandor
6,000,583 A * 12/1999 Stern et al. ..... 239/394
6,257,503 B1 * 7/2001 Baudin ..... 239/337
6,386,402 B1 5/2002 Woods
6,536,633 B2 * 3/2003 Stern et al. ..... 239/394
6,557,783 B1 * 5/2003 Foster et al. ..... 239/505
7,014,073 B1 * 3/2006 Stern et al. ..... 239/337

* cited by examiner

*Primary Examiner*—Steven J. Ganey
(74) *Attorney, Agent, or Firm*—Pillsbury Winthrop Shaw Pittman LLP

(57) ABSTRACT

A specialized nozzle assembly that dispenses spray patterns of varying textures, e.g., coarse or fine particles; for use in an aerosol system for applying a spray texture material to a wall or like supporting structure. The nozzle assembly includes an elongated passageway and a generally cone-shaped member attached thereon.

22 Claims, 2 Drawing Sheets

VARIABLE AEROSOL NOZZLE

FIELD OF THE INVENTION

1. Field of the Invention

Embodiments of the present invention relate generally to an aerosol system for applying a spray texture material to a wall or like supporting structure. More particularly, embodiments are directed to a nozzle adapted to provide variable spraying of the material so as to dispense spray patterns that may vary in texture, e.g., coarser or finer particles, may be achieved. The system further comprises an aerosol container that holds the pressurized spray texture material. The material is dispensed through a dip tube that connects to a nozzle. The spray texture material exits from the container through the nozzle.

2. Description of Related Art

It has been the conventional practice in the procedure of repairing drywall or other like areas to remove the damaged portion of the surface and subsequently fill any holes, depressions, or the like with a prepared patch material. The patch or replacement material is applied by means of a trowel or other flattening tool that will press the patch material into the hole or depression and that will prepare and provide a surface area to receive a finish surface coating. After the patch material has cured and adhered to the original support material, a smooth surface is provided that receives the final coating. This coating leaves a smooth surface that is unmatched to the surrounding textured or roughened surface.

Drywall or other like surfaces usually present a surface texture that is not smooth but has an irregular texture or look. Such an appearance and surface texture cannot be attained through the use of smoothing tools or patch tools once the patch material has been applied to the damaged or repaired area. Therefore, difficulties and problems have been encountered that stem largely from the fact that the use and application of conventional patching materials on the repairs of such surfaces leaves a surface texture that does not match the surrounding area and is noticeable after the repair has been completed.

Thus, there have been developed sprayable texture materials that can be conveniently used to repair or patch drywall or other like surfaces in a manner that provides a repair area that visually assumes the surface texture of the surrounding wall area. U.S. Pat. No. 6,386,402, to the present Applicant, discloses a sprayable drywall texture that is sprayable from a hand-held aerosol dispenser and is hereby incorporated in its entirety.

However, because the wall textures themselves may vary, e.g. coarser or finer texture, it is useful to have a single aerosol apparatus that may dispense the sprayable material in more than one spray texture. There are known apparatuses which provide variable nozzle which may spray varying textures, however, those involve nozzles having multiple outlet components or requiring various manual steps.

Therefore, there is a need for an aerosol apparatus that has a nozzle that can spray varying texture patterns in a more simple and efficient manner, without involving too many components or steps.

BRIEF SUMMARY OF THE INVENTION

In accordance with embodiments of the invention, an object of an embodiment of the present invention is to provide an apparatus with a specialized nozzle that can provide spray patterns of varying textures in a simple and efficient manner.

In an embodiment, there is provided a nozzle having an elongated passageway that extends from the nozzle that serves as an extension of the nozzle. Slidably attached to this elongated passageway is a generally cone-shaped member which is adapted to slide from a first position to a second position interchangeably. For example, the generally cone-shaped member may be slidably attached by screwing threads on the inside of the cone-shaped member and on the outside of the elongated passageway that allow the cone-shaped member to swivel up and down the elongated passageway. When the cone member is in the first position, the cone member is located closer to the nozzle. When the cone member is in the second position, the cone member is located at the end of the elongated passageway, farthest away from the nozzle. In the first position, the sprayable material contained in the aerosol apparatus will be dispensed according to the sole orifice of the single elongated passageway. The spray will be smaller in scope and more concentrated with finer particles. In the second position, the cone member is located at the end of the elongated passageway and thus expands the trajectory of the spray as it exits the single orifice of the single elongated passageway. The second position thus facilitates a broader spray which is less concentrated with coarser particles. In embodiments, the slidably attached member is generally flared.

The variation between dispensing a finer texture and dispensing a more coarse texture is thus provided through the cone member. The sprayable product exits from only one orifice, that of the elongated passageway, which does not vary in diameter or cross-sectional area. Whether the generally cone-shaped member is in the first or the second position, the sprayable product is dispensed through the unchanging diameter of the sole orifice of the elongated passageway.

BRIEF DESCRIPTION OF THE DRAWINGS

A detailed description of embodiments of the invention will be made with reference to the accompanying drawings, wherein like numerals designate corresponding parts in the figures.

DETAILED DESCRIPTION OF THE INVENTION

In the following description, reference is made to the accompanying drawings which form a part hereof and which illustrate several embodiments of the present inventions. It is understood that other embodiments may be utilized and structural and operational changes may be made without departing from the scope of the present inventions.

Figure 1:
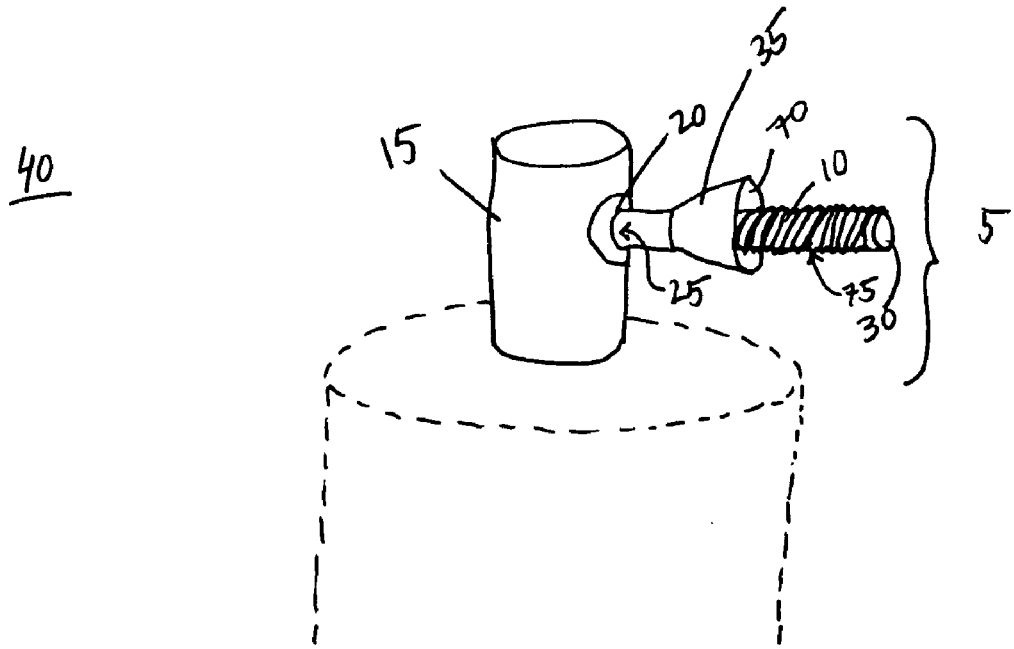
FIG. 1 illustrates a perspective view of a variable nozzle with a generally cone-shaped member in a first position according to an embodiment of the invention.

As shown in FIG. 1, there is provided a nozzle assembly 5 of an aerosol apparatus for spraying variable textures. The nozzle assembly 5 has a single elongated passageway 10 that extends from an actuator 15. The actuator 15 includes an aperture 20 forming a nozzle opening 25 to which the elongated passageway 10 is connected and from which the elongated passageway 10 serves as an extension. The elongated passageway 10 has a single orifice 30 from which the spray exits. Slidably attached to this elongated passageway 10 is a generally flared or cone-shaped member 35 which is adapted to slide from a first position 40 to a second position 45 interchangeably. For example, in the embodiment shown in FIG. 1 and FIG. 2, the generally cone-shaped member may be slidably attached by screwing threads 75 that allow the cone-shaped member to swivel up and down the elongated passageway. In the first position 40, as depicted in FIG. 1, the cone member 35 is located closer to the actuator 15. In the second position 45, as depicted in FIG. 2, the cone member 35 is located at the end of the elongated passageway 10, farthest away from the actuator 15.

In the first position 40, the sprayable material contained in the aerosol apparatus will be dispensed according to the single orifice 30 of the elongated passageway 10. The spray will be smaller in scope and more concentrated with finer particles. In the second position 45, the cone member 35 is located at the end of the elongated passageway 10 and thus expands the trajectory of the spray as it exits the orifice 30 of the elongated passageway 10, as can be seen in FIG. 2. The second position 45 thus facilitates a broader spray which is less concentrated with coarser particles.

Figure 2:
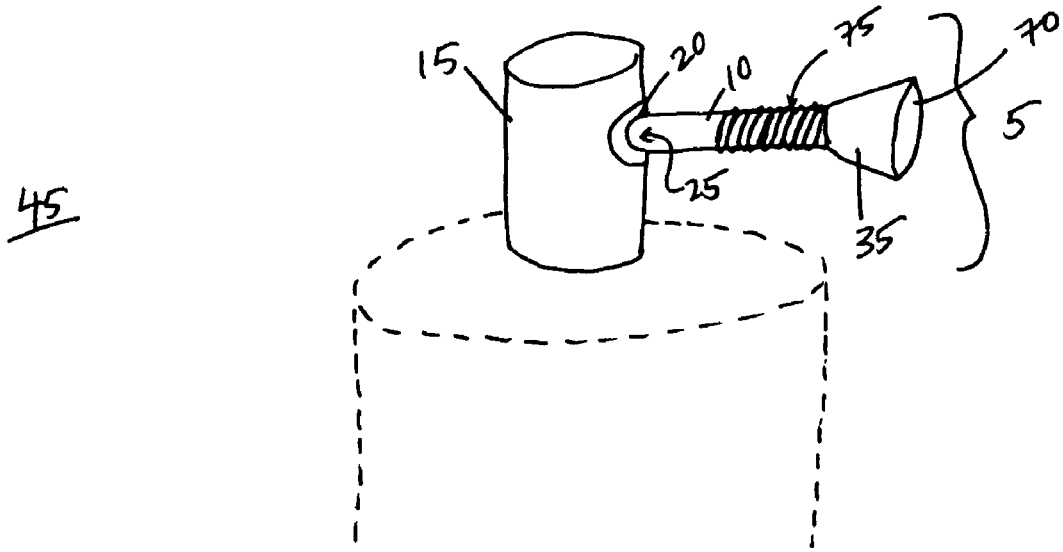
FIG. 2 illustrates perspective view of a variable nozzle with a generally cone-shaped member in a second position according to an embodiment of the present.

The variability of the dispensed spray is provided by the positions of the generally flared or cone-shaped member 35, shown in FIGS. 1 and 2. The difference in spray texture is caused by the manner in which the cone member 35 expands the trajectory of the spray as it exits the orifice 30 of the elongated passageway 10 in the second position 45. The sprayable product exits from only one orifice 30, that of the single elongated passageway 10, which remains constant in diameter. Whether the cone member 35 is in the first position 40 or the second position 45, the sprayable product is dispensed through the unchanging diameter of the orifice 30 of the elongated passageway 10, which provides a convenient and efficient manner of varying spray textures without involving much manipulation or multiple parts. The variation of spray textures is achieved by simply sliding the cone member 35 on the elongated passageway 10 from the first position 40 to the second position 45. The cone member 35, in the second position 45, extends the trajectory of the exiting material and thus provides a broader spray with coarser, less concentrated texture. In either position, the sprayable material is dispensed from the same orifice 30. The orifice 30 of the elongated passageway 10 and the orifice 70 of the cone member 35 each remain the same and do not vary, nor are they ever switched for a counterpart with a larger or smaller orifice.

Figure 3:
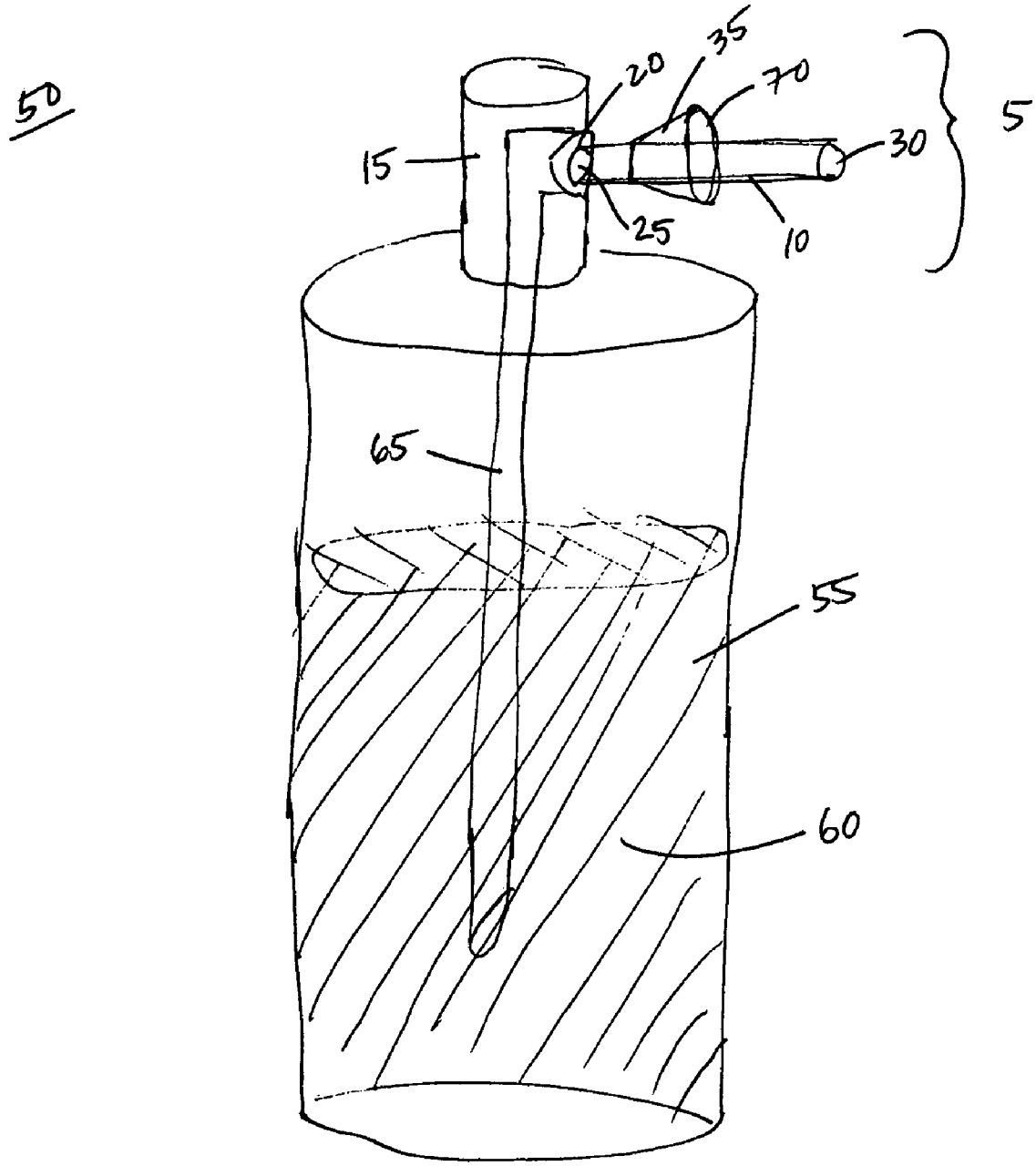
FIG. 3 illustrates a cross-sectional perspective view of an aerosol system having a variable nozzle with a generally cone-shaped member in a first position according to an embodiment of the present.

In FIG. 3, an aerosol system, using the nozzle assembly 5 according to an embodiment of the invention, is illustrated schematically by the reference numeral 50. The system 50 comprises a container 55 that holds a sprayable texture material 60, a dip tube 65 disposed inside the container in contact with the sprayable texture material 60, and a nozzle assembly 5. The dip tube 65 has a top opening and a bottom opening disposed and extends to a bottom of the container 55 without contacting the bottom. The nozzle assembly 5 is disposed on the container 55 and connected to the dip tube 65. As discussed above, the nozzle assembly 5 comprises an actuator 15 with an aperture 20 forming a nozzle opening 25 capable of dispensing variable sprays of the sprayable texture material 60 when the actuator 15 is depressed. An elongated passageway 10 is connected to the nozzle opening 25 and extends therefrom. The nozzle assembly 5 maintains fluid communication with the dip tube 65 and is adapted to open the communication when the actuator 15 is depressed, allowing the sprayable texture material 60 to be dispensed out through the elongated passageway 10 as with other aerosol spray systems or apparatuses known in the art. Fluid communication is closed when the actuator 15 is released. The container may include a propellant, such as compressed air or liquid gas, to further facilitate the force of expulsion and blast velocity released.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are, therefore, to be considered in all respects as illustrative and not restrictive, the scope of the invention being indicated by the appended claims rather than the foregoing description. All changes that come within the meaning of and range of equivalency of the claims are intended to be embraced therein.

What is claimed is:

1. A nozzle assembly for spraying variable textures, comprising:

an actuator with an aperture forming a nozzle opening that dispenses a sprayable texture material when the actuator is depressed, an elongated passageway having an orifice extending from the nozzle opening, wherein the sprayable texture material enters the elongated passageway and passes through the elongated passageway to the orifice from which a spray of the dispensed sprayable texture material exits, and a generally cone-shaped member slidably attached to the elongated passageway, wherein the cone member is adapted to slide from a first position to a second position in which one position causes the spray to exit through the cone-shaped member.

2. The nozzle assembly of claim 1, wherein the first position causes the spray to exit the elongated passageway to provides a spray with fine texture and the second position causes the spray to exit through the cone-shaped member to provides a spray with coarse texture.

3. The nozzle assembly of claim 1, wherein the generally cone-shaped member expands the trajectory of the spray as it exits the orifice of the elongated passageway in the second position.

4. The nozzle assembly of claim 1, wherein the generally cone-shaped member is made of an elastic material.

5. The nozzle assembly of claim 1, wherein the generally cone-shaped member is made of a rigid material.

6. The nozzle assembly of claim 1 further being adapted to be reused with a new actuator after the sprayable texture material is finished dispensing.

7. The nozzle assembly of claim 1, wherein the generally cone-shaped member is slidably attached to the elongated passageway by screwing threads.

8. A nozzle assembly for spraying variable textures, comprising:

an actuator with an aperture forming a nozzle opening that dispenses a sprayable texture material when the actuator is depressed;

an elongated passageway having an orifice extending from the nozzle opening, wherein the sprayable texture material enters the elongated passageway and passes through the elongated passageway to the orifice from which a spray of the dispensed sprayable texture material exits; and a flared member slidably attached to the elongated passageway, wherein the flared member is adapted to slide from a first position to a second position, the first position causing the spray to exit the elongated passageway to provide a spray with fine texture and the second position causing the spray to exit through the flared member to provide a spray with coarse texture.

9. An aerosol system for spraying variable textures, comprising:

a container for holding sprayable texture material with sprayable texture material contained therein;

a dip tube disposed inside the container; and a nozzle assembly disposed on the container and connected to the dip tube, the nozzle assembly comprising an actuator with an aperture forming a nozzle opening that dispenses the sprayable texture material when the actuator is depressed, an elongated passageway having an orifice extending from the nozzle opening, wherein the sprayable texture material enters the elongated passageway and passes through the elongated passageway to the orifice from which a spray of the dispensed sprayable texture material exits, and a generally cone-shaped member slidably attached to the elongated passageway, wherein the generally cone-shaped member is adapted to slide from a first position to a second position in which one position causes the spray to exit through the cone-shaped member.

10. The aerosol system of claim 9, wherein the first position causes the spray to exit the elongated passageway to provides a spray with fine texture and the second position causes the spray to exit through the cone-shaped member to provides a spray with coarse texture.

11. The aerosol system of claim 9, wherein the generally cone-shaped member expands the trajectory of the spray as it exits the orifice of the elongated passageway in the second position.

12. The aerosol system of claim 9, wherein the generally cone-shaped member is made of an elastic material.

13. The aerosol system of claim 9, wherein the generally cone-shaped member is made of a rigid material.

14. The aerosol system of claim 9, wherein the nozzle assembly is adapted to be reused with a new actuator after the sprayable texture material is finished dispensing.

15. The aerosol system of claim 9, wherein the generally cone-shaped member is slidably attached to the elongated passageway by screwing threads.

16. An aerosol apparatus for spraying variable textures, comprising:

a container for holding sprayable texture material;

a dip tube disposed inside the container; and a nozzle assembly disposed on the container and connected to the dip tube, the nozzle assembly comprising an actuator with an aperture forming a nozzle opening that dispenses a sprayable texture material when the actuator is depressed, an elongated passageway having an orifice extending from the nozzle opening, wherein the sprayable texture material enters the elongated passageway and passes through the elongated passageway to the orifice from which a spray of the dispensed sprayable texture material exits, and a generally cone-shaped member slidably attached to the elongated passageway, wherein the generally cone-shaped member is adapted to slide from a first position to a second position in which one position causes the spray to exit through the cone-shaped member.

17. The aerosol apparatus of claim 16, wherein the first position causes the spray to exit the elongated passageway to provides a spray with fine texture and the second position causes the spray to exit through the cone-shaped member to provides a spray with coarse texture.

18. The aerosol apparatus of claim 16, wherein the generally cone-shaped member expands the trajectory of the spray as it exits the orifice of the elongated passageway in the second position.

19. The aerosol apparatus of claim 16, wherein the generally cone-shaped member is made of an elastic material.

20. The aerosol apparatus of claim 16, wherein the generally cone-shaped member is made of a rigid material.

21. The aerosol apparatus of claim 16, wherein the nozzle assembly is adapted to be reused with a new actuator after the sprayable texture material is finished dispensing.

22. The aerosol apparatus of claim 16, wherein the generally cone-shaped member is slidably attached to the elongated passageway by screwing threads.

* * * * *